US006341965B1

(12) United States Patent
Lin

(10) Patent No.: US 6,341,965 B1
(45) Date of Patent: Jan. 29, 2002

(54) ELECTRIC CONNECTOR WITH SHIELDING EFFECT

(75) Inventor: Rong-Huei Lin, Taipei Hsien (TW)

(73) Assignee: Starlink Electronics Corp., Taipei Hsien (TW)

( * ) Notice: Subject to any disclaimer, the term of this patent is extended or adjusted under 35 U.S.C. 154(b) by 0 days.

(21) Appl. No.: 09/376,327

(22) Filed: Aug. 18, 1999

(51) Int. Cl.[7] ..... H01R 4/66; H01R 13/648
(52) U.S. Cl. ..... 439/108
(58) Field of Search ..... 439/108, 101, 439/60, 637, 630, 924.1, 631, 632, 636

(56) References Cited

U.S. PATENT DOCUMENTS 5,026,292 A * 6/1991 Pickles et al. ..... 439/108
5,620,342 A * 4/1997 Kinross ..... 439/637
5,662,483 A * 9/1997 Park et al. ..... 439/101

* cited by examiner

*Primary Examiner*—Renee Luebke
*Assistant Examiner*—Briggitte R. Hammond
(74) *Attorney, Agent, or Firm*—Troxell Law Office PLLC

(57) ABSTRACT

A slot connector for receiving a circuit substrate has a long insulating housing with a central slot. Banks of terminal receiving grooves are arranged at sides of the insulating housing. Each bank has terminal receiving grooves having alternatively arranged signal terminal receiving grooves and grounding terminal receiving grooves. A signal terminal is received within each respective signal terminal receiving groove. Each signal terminal includes a contact portion, a flexible arm, a fixing portion and a pin portion. A grounding terminal is received with each grounding terminal. Each grounding terminal includes a circuit substrate, a flexible arm, a fixing portion, and a pin portion. At least one of the contact portion, elastic arm, and fixing portion of each grounding terminal is larger than that of the respective portion of the signal terminal.

5 Claims, 3 Drawing Sheets

ELECTRIC CONNECTOR WITH SHIELDING EFFECT

BACKGROUND OF THE INVENTION

1. Field of the Invention

This invention relates to a high density slot electric connector, and especially to an electric connector for enhancing the shielding effect.

2. Description of the Prior Art

Since information technology is improved quickly, the information devices are more and more popular. Therefore, the requirement of electric connectors is increased vastly, and thus high density becomes a trend in the design of electric connector for reducing the sizes of the devices. However, in high frequency transmission, noise and interruption will become a serious problem due to the compact arrangement of the high density connectors. In general, grounding and shielding resolves these problems. In grounding, a grounding loop is used in the system with a grounding terminal connected with the grounding loop installed between the signal terminals for achieving the system grounding. In many applications of high frequency transmission, in order to insure an effective and reliable grounding, the signal terminals and grounding terminals are arranged alternatively one by one, such as in U.S. Pat. No. 5,026,292. This patent is incorporated into the present invention as a reference.

Although the aforementioned design somewhat decreases the noise and interruption, however, in a high speed and large quantity transmission system, the aforesaid design cannot effectively resolve the problem of interruption. Moreover, the number of grounding terminals is increased, so the normal clamping force that the terminals clamp the edge of the circuit track (golden finger) of a circuit substrate is also increased. As a result, the circuit substrate is difficult to pull out of and to insert into, the connector.

SUMMARY OF THE INVENTION

A slot connector for receiving a circuit substrate comprises a long insulating housing with a central slot being disposed in the longitudinal direction of the insulating housing and a bank of terminal receiving grooves being longitudinally arranged at two sides of the insulating housing. Each bank of terminal receiving grooves is formed by alternatively arranged signal terminal receiving grooves and grounding terminal receiving grooves. A plurality of signal terminals are received with the respective signal terminal receiving grooves. Each signal terminal includes a contact portion, a flexible arm, a fixing portion and a pin portion. A grounding terminal is received within the respective grounding terminal grooves. Each grounding terminal includes a contact portion, a flexible arm, a fixing portion, and a pin portion. At least one of the contact portion, elastic arm, and fixing portion of each grounding terminal has a size larger than that of the corresponding portion of the respective signal terminal.

The contact point between the grounding terminal and the circuit substrate has a position higher than the contact point between the signal terminal and the circuit substrate. When the circuit substrate has not been inserted, the gap between contact points of each paired grounding terminal to be contacted with the circuit substrate is thinner than the gap between the contact points of each paired signal terminal. Alternatively, the contact point between the signal terminal and the circuit substrate has a position higher than the contact point between the grounding terminal and the circuit substrate and when the circuit substrate has not been inserted, the gap between contact points of each paired signal terminal to be contacted with the circuit substrate is thinner than the gap between the contact points of each paired grounding terminal.

BRIEF DESCRIPTION OF THE DRAWINGS

The present invention will be better understood and its numerous objects and advantages will become apparent to those skilled in the art by referencing to the following drawings in which.

DETAILED DESCRIPTION OF THE PREFERRED EMBODIMENT

The following embodiments with the appended figures will describe the present invention. However, these embodiments and figures are to be used only to describe the present invention instead of limiting the present invention which is defined solely by the appended claims.

Figure 1:
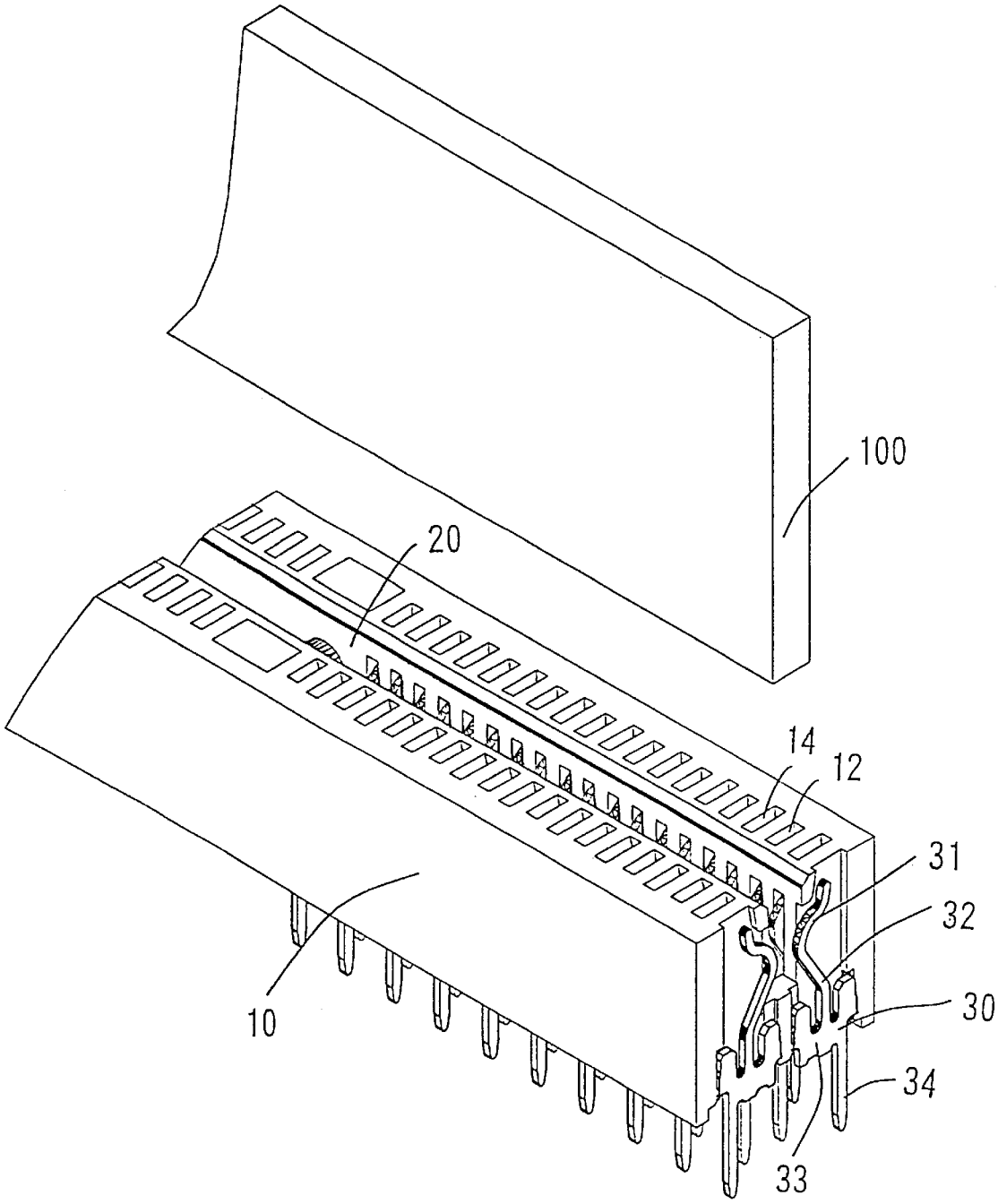
FIG. 1 is a partial, perspective view of the electric connector of the present invention.

With reference to FIG. 1, the electric connector of the present invention includes a long insulating housing 10 with a central slot 20 in the longitudinal direction of the insulating housing 10. The central slot 20 serves to receive the edge of a circuit substrate 100. A bank of terminal receiving grooves is longitudinally arranged at two sides of the insulating housing 10. Each bank of terminal receiving grooves is formed by alternatively arranged signal terminal receiving grooves 12 and grounding terminal receiving grooves 14. It is appreciated form the figure that the size of the signal terminal receiving groove 12 is slightly different from that of the grounding terminal receiving, groove 14. This because that the size of the signal terminal of the present invention is slightly smaller than that of the grounding terminal receiving groove. This will be further described in the following description.

Figure 2A:
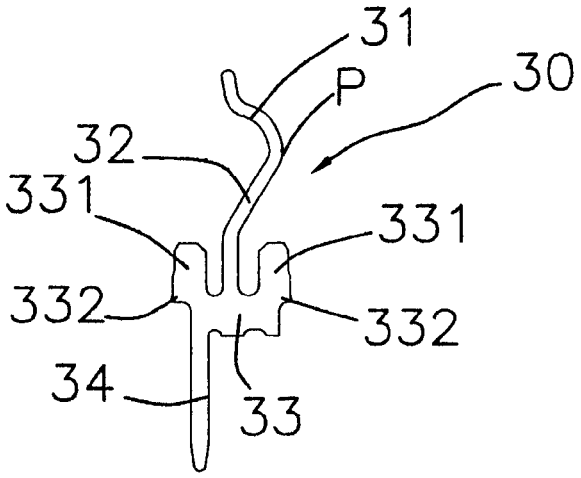
FIG. 2A is a side view showing the signal terminal of the present invention.
Figure 2B:
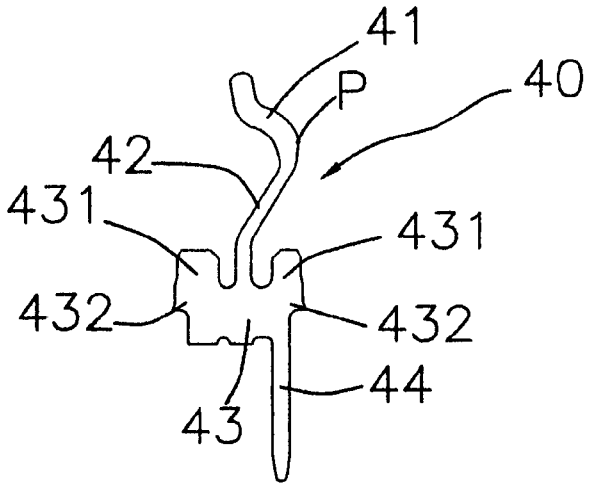
FIG. 2B is a side view showing the grounding terminal of the present invention.

With reference to FIGS. 2A and 2B, the side views of the signal terminal 30 and the grounding terminal 40 of the present invention are illustrated. It is appreciated from the figures that each signal terminal 30 includes a contact portion 31, a flexible arm 32, a fixing portion 33 and a pin portion 34. The contact portion 31 includes the portion from the uppermost edge of the signal terminal 30 downwards to approximately the contact point P contacting with the circuit substrate 100. The elastic arm 32 includes the portion from the contact point P to the fixing portion 33. The elastic arm 32 provides flexible deformation as the circuit substrate 100 inserted into the central slot 20 so that the contact portion 31 has sufficient normal force to firmly and reliably contact with the edge of the circuit substrate 100. The fixing portion 33 firmly secures the signal terminal 30 in the signal terminal receiving groove 12. This is achieved by a buckling flange 331 protruding from the two sides of the fixing portion 33 to engage an inner wall of the signal terminal receiving groove 12. An inverse hook 332 protrudes upwards from the each buckling flange 331 facing to the signal terminal receiving groove 12. This inverse hook 332 is used to prick into the inner wall of the signal terminal receiving groove 12 as the signal terminal 30 is installed within the signal terminal receiving groove 12 in order to prevent that the signal terminal 30 from dropping out of the signal terminal receiving groove 12. A pin portion 34 downwardly extends from the lower portion of the fixing portion 33 for being inserted into the respective hole on a primary circuit board (not shown) so as to connect with the circuit on the primary circuit board.

Each grounding terminal 40 includes a contact portion 41, a flexible arm 42, a fixing portion 43 and a pin portion 44. The fixing portion 43 further includes a buckling flange 431 and an inverse hook 432. Since the structures of the grounding terminal 40 and the signal terminal 30 are approximately identical, thus the detail about the components thereof will not be described herein.

It will be appreciated from FIGS. 2A and 2B that the transverse dimension of contact portion 41 of the grounding terminal 40 is larger than that of the contact portion 31 of the signal terminal 30. Moreover, the overall transverse dimension of the fixing portion 43 of the grounding terminal 40 is larger than that of the fixing portion 31 of the signal terminal 30. Thereby, when signals are transferred in the signal terminal 30 between two adjacent grounding terminals 40, the enlarged portions of the two grounding terminals 40 on either side of the signal terminal 30 will provide a shielding effect. Thus, the interruption of the signal transferred by the signal terminal 30 is greatly reduced. It should be noted that the spirit of the present invention is that some specific portions of the grounding terminal are designed to be slightly larger than the respective portions of the signal terminal. The numbers and positions of the specific portions are dependent on the shape, application, and assembly of the terminal. Although, in this embodiment, the enlarged contact portion 41 and fixing portion 43 of the grounding terminal 40 serves as an example for describing the present invention, this will not limit the present invention. Alternatively, as described above, the receiving groove 14 of the grounding terminal in the present invention is designed to be larger than the signal terminal receiving groove 12. By providing some specific portions of the grounding terminal to be slightly larger than the respective portions of the signal terminal, the assembling operation may easily identify the signal terminal and the grounding terminal.

As described above, due to the high density of the electric connector, the problem of an increase in the number of terminals increasing the inserting force of the circuit substrate 100 into the central slot 20 must be considered. The present invention provides a solution to this problem.

Figure 3:
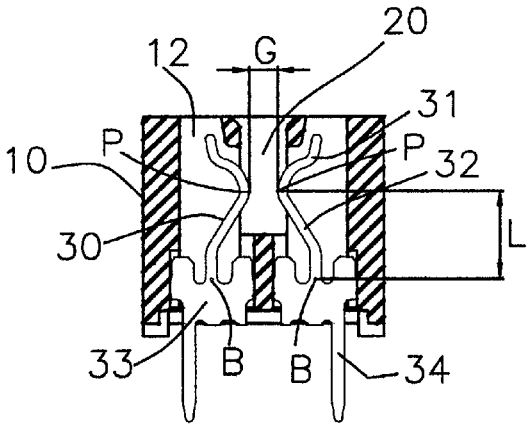
FIG. 3 is a cross sectional view showing the signal terminal of the present invention placed within a receiving groove.
Figure 4:
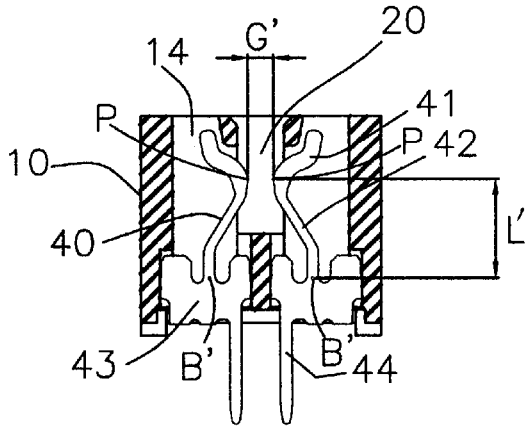
FIG. 4 is a cross sectional view showing the grounding terminal of the present invention placed within a receiving groove.
Figure 5:
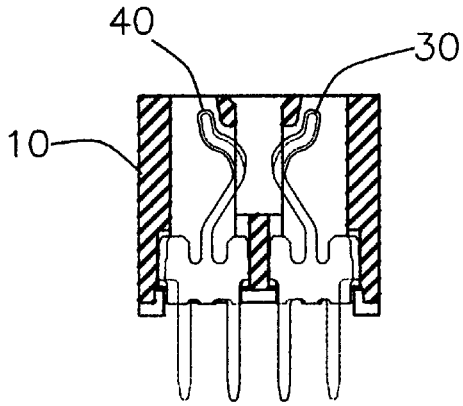
FIG. 5 is a cross sectional view showing the overlapped signal terminals and the grounding terminals in the receiving grooves, wherein the grounding terminals are indicated by solid lines, and the signal terminals are indicated by dashed lines.

With reference to FIGS. 3, 4, and 5, FIGS. 3 and 4 show the cross sectional views of the signal terminal and the grounding terminal, respectively, while FIG. 5 is a schematic cross sectional view showing that the signal terminal and the grounding terminal overlapped. Referring to appended figures, if the vertical distance from the contact point P of the contact portion 31 of the signal terminal 30 to the bending point B of the elastic arm 32 of the signal terminal is L, and the vertical distance from the contact point P' of the contact portion 41 of the grounding terminal 40 to the bending point B' of the elastic arm 42 of the grounding terminal 40 is L', then it can be seen clearly from FIGS. 3 and 4, the distance L' is larger than L. In other words, when the circuit substrate 100 is inserted into the central slot 20, the edge of the circuit substrate firstly contacts the grounding terminals of the electric connector, and then when the circuit substrate 100 is further inserted, the edge further contacts the signal terminals of the electric connector. By this design, the forces are applied on the circuit substrate in two stages, to avoid a large force applied to the circuit substrate at one time, so that the circuit substrate is easier to be inserted.

However, those skilled in the art may appreciate that the above different elevations of contact points will induce a problem caused by different terminal applying different forces (this is because that the arms of force of deformation torque L and L' are different). In other words, if the stresses between terminals are different, after several insertions, the elastic fatigues of the terminals on the circuit substrate are different. Thus, some terminals will have bad contact. In order to solve such a problem, the present invention controls the displacements of different terminals so that the normal clamping forces on the edge of the circuit substrate from different terminals are approximately equal. In detail, with reference to FIGS. 3 and 4, the horizontal distance between the contact points P of a pair of signal terminals is G, while the horizontal distance between the contact points P' of a pair of grounding terminals is set as G'. Then, it is apparent that in the present invention, the horizontal distance between the contact points P of a pair of signal terminals G is larger than the horizontal distance structure the contact points P' of a pair of grounding terminals G'. Thereby, when the circuit substrate is inserted into the central slot of the electric connector, the normal clamping force of the signal terminals and the grounding terminals are approximately equal.

With reference to FIG. 5, the grounding terminals therein are indicated by solid lines, while the signal terminals are indicated by dashed lines. It can be seen from the figure that by the assembled contact portion 41 and fixing portion 43 of the grounding terminal 40 of the present invention will effectively shield the respective portions (i.e. contact portion 31 and the fixing portion 33) of the signal terminal 30 and thus, interference is effectively reduced. Since, in the present invention, the grounding terminals and the signal terminals are contacted in different levels, moreover, the gaps between contact points of paired terminals are varied. Thus, the electric connector of the present invention not only reduces the inserting force of the circuit substrate, but also the grounding terminal and the signal terminal can be retained with an approximately equal clamping force.

Although the present invention has been described using a specified embodiment, the examples are meant to be illustrative and not restrictive. It is clear that many other variations would be possible without departing from the basic approach, demonstrated in the present invention.

What is claimed is:

1. A slot connector for receiving an edge of a substrate having a circuit thereon and comprising:

a) an elongated housing having: an elongated central slot extending in a longitudinal direction, the slot configured to receive therein the edge of the substrate; a bank of terminal receiving grooves located on two opposite sides of the central slot, each bank having a plurality of signal terminal receiving grooves alternating with a plurality of grounding terminal receiving groove such that the grounding terminal receiving grooves are located on opposite sides of the signal terminal receiving grooves;

b) a signal terminal located in each of the plurality of signal terminal grooves, each signal terminal having a signal contact portion, a signal flexible arm portion, a signal fixing portion, a signal pin portion, and a contact point P, at a juncture of the signal contact portion and the signal flexible arm portion, located a distance L from a juncture of the signal flexible arm portion and the signal fixing portion; and, c) a grounding terminal located in each of the plurality of grounding terminal grooves, each grounding terminal having a grounding contact portion, a grounding flexible arm portion, a grounding fixing portion, a grounding pin portion, and a contact point P' at a juncture of the grounding contact portion and the grounding flexible arm portion, located a distance L' from a juncture of the grounding flexible arm portion and the grounding fixing portion, wherein L' is greater than L, a gap G between contact points P on opposite sides of the central slot prior to insertion of the substrate is being larger than a gap G' between contact points P' on opposite sides of the central slot prior to insertion of the substrate, and at least one of the grounding contact portion, the grounding flexible arm portion and the grounding fixing portion having a dimension transverse to the central slot greater than the corresponding portion of the signal terminals to provide a shielding effect between adjacent signal terminals.

2. The slot connector of claim 1 wherein a dimension transverse to the central slot of the grounding fixing portion is larger than a corresponding dimension of the signal fixing portion.

3. The slot connector of claim 1 further comprising buckling flanges extending from opposite sides of the grounding fixing portions and the signal fixing portions, the buckling flanges including inverse hook portions.

4. The slot connector of claim 1 wherein a dimension transverse to the central slot of the grounding contact portion is larger than a corresponding dimension of the signal contact portion.

5. The slot connector of claim 4 wherein a dimension transverse to the central slot of the grounding fixing portion is larger than a corresponding dimension of the signal fixing portion.

* * * * *